US009647365B2

(12) United States Patent
Ogino

(10) Patent No.: US 9,647,365 B2
(45) Date of Patent: May 9, 2017

(54) ELECTRIC CONNECTOR

(71) Applicant: DAI-ICHI SEIKO CO., LTD., Kyoto (JP)

(72) Inventor: Tomohiro Ogino, Fukuoka (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 14/955,561

(22) Filed: Dec. 1, 2015

(65) Prior Publication Data

US 2016/0204533 A1 Jul. 14, 2016

(30) Foreign Application Priority Data

Jan. 9, 2015 (JP) ..... 2015-003584

(51) Int. Cl.
*H01R 3/00* (2006.01)
*H01R 12/77* (2011.01)
*H01R 12/88* (2011.01)

(52) U.S. Cl.
CPC ..... *H01R 12/771* (2013.01); *H01R 12/88* (2013.01)

(58) Field of Classification Search
CPC ..... H01R 12/79; H01R 12/88; H01R 12/774; H01R 23/684; H01R 23/668
(Continued)

(56) References Cited

U.S. PATENT DOCUMENTS 4,778,403 A * 10/1988 Ikesugi ..... H01R 12/79 439/329
6,332,801 B1 12/2001 Watanbe
(Continued)

FOREIGN PATENT DOCUMENTS

JP 60-005081 U 1/1985
JP 7-142130 6/1995
(Continued)

OTHER PUBLICATIONS

Japanese Office Action issued Nov. 1, 2016 in Japanese Application No. 2015-003584 (3 pages).
(Continued)

*Primary Examiner* — Abdullah Riyami
*Assistant Examiner* — Vladimir Imas
(74) *Attorney, Agent, or Firm* — Oblon, McClelland, Maier & Neustadt, L.L.P.

(57) ABSTRACT

The contact state of a signal transmission medium and contact members is enabled to be maintained well by a simple configuration. Medium pressing portions of an actuator, which is subjected to a moving operation so as to electrically connect contact portions of contact members, which are in a multipolar arrangement, and a signal transmission medium (FPC, FFC, or the like) to each other, are disposed at the same positions as the contact portions of the contact members in the direction of the multipolar arrangement. The medium pressing portions of the actuator at the positions directly opposed to the contact portions of the contact members are configured to press the signal transmission medium when the actuator is moved to a working position so that the contact pressures applied from the medium pressing portions of the actuator to the signal transmission medium are reliably applied to the contact portions of the contact members without being dispersed.

6 Claims, 16 Drawing Sheets

(58) Field of Classification Search
USPC ..... 439/495, 492, 260, 660
See application file for complete search history.

(56) References Cited

U.S. PATENT DOCUMENTS

| | | | | |
|---|---|---|---|---|
| 7,179,118 | B1 * | 2/2007 | Harlan | H01R 12/774 439/260 |
| 7,261,589 | B2 * | 8/2007 | Gillespie | H01R 12/774 439/260 |
| 7,275,955 | B2 * | 10/2007 | Ko | H01R 12/61 439/498 |
| 7,297,020 | B2 * | 11/2007 | Takahira | H01R 12/88 439/495 |
| 7,452,227 | B2 * | 11/2008 | Matoba | H01R 12/778 439/260 |
| 7,527,511 | B1 * | 5/2009 | Peng | H01R 12/78 439/260 |
| 7,553,183 | B2 * | 6/2009 | Taketomi | H01R 12/79 439/260 |
| 7,766,680 | B2 * | 8/2010 | Suzuki | H01R 12/79 439/260 |
| 8,128,425 | B2 * | 3/2012 | Takahashi | H01R 12/79 439/260 |
| 8,641,439 | B2 * | 2/2014 | Tateishi | H01R 12/88 439/260 |
| 8,678,844 | B2 * | 3/2014 | Yoshisuji | H01R 12/592 439/260 |
| 8,920,183 | B2 * | 12/2014 | Shimada | H01R 12/88 439/260 |
| 8,936,480 | B2 * | 1/2015 | Hsieh | H01R 12/79 439/261 |
| 9,099,822 | B2 * | 8/2015 | Miki | H01R 12/79 |
| 9,153,888 | B2 * | 10/2015 | Kajiura | H01R 12/72 |
| 9,160,101 | B2 * | 10/2015 | Takane | H01R 12/79 |
| 9,166,332 | B2 * | 10/2015 | Matoba | H01R 13/6275 |
| 9,306,321 | B2 * | 4/2016 | Shimada | H01R 12/88 |
| 2006/0172590 | A1 * | 8/2006 | Yamada | H01R 12/88 439/495 |
| 2007/0134975 | A1 | 6/2007 | Shin | |
| 2011/0237106 | A1 * | 9/2011 | Wada | H01R 12/88 439/329 |

FOREIGN PATENT DOCUMENTS

| | | |
|---|---|---|
| JP | 2005-251760 | 9/2005 |
| JP | 2007-503702 A | 2/2007 |
| TW | 477092 | 2/2002 |
| TW | 549650 | 8/2003 |

OTHER PUBLICATIONS

Korean Office Action issued Jan. 26, 2017 in Korean Application No. 10-2015-0180707 (4 pages).

Combined Office Action and Search Report issued Feb. 21, 2017 in Taiwanese Patent Application No. 104139909.

* cited by examiner

ELECTRIC CONNECTOR

BACKGROUND OF THE INVENTION

Field of the Invention

The present invention relates to an electric connector configured so as to electrically connect contact members and a signal transmission medium to each other by subjecting an actuator to a moving operation.

Description of Related Art

Generally, in various electric devices, etc., various electric connectors are widely used as means for electrically connecting various signal transmission media such as flexible printed circuits (FPC) and flexible flat cables (FFC). For example, in an electric connector mounted and used on a printed wiring substrate like below-described Japanese Patent Application Laid-Open No. 2005-251760, Japanese Patent Application Laid-Open No. H07-142130, etc., a signal transmission medium consisting of the above described FPC, FFC, or the like is inserted to the interior thereof through an opening of an insulating housing (insulator), and an actuator (connection operating means) at "standby position (opened position)" at which the signal transmission medium is caused to be in an opened state at that point of time is configured to be turned so as to be pushed down toward "working position (closed position)" in the front side or the rear side of the electric connector by the operating force of an operator.

Then, when the above described actuator (connection operating means) is subjected to a moving (turning) operation to "working position (closed position)" at which the signal transmission medium is sandwiched, a medium pressing portion (pressurizing portion) provided on the actuator is brought into pressure-contact with the surface of the signal transmission medium (FPC, FFC, or the like), and the pressing force of the medium pressing portion (pressurizing portion) of the actuator electrically connects electrically-conductive paths provided on the signal transmission medium to contact portions of contact members and, at the same time, causes the signal transmission medium to be in a fixed state. On the other hand, when the actuator at the "working position (closed position)" is subjected to a moving (turning) operation toward the previous "standby position (opened position)" in the direction to raise it to the upper side, the pressing force of the medium pressing portion (pressurizing portion) of the actuator is released, and, when it reaches the "standby position (opened position)", the signal transmission medium can be removed.

Herein, conventional electric connectors have a tendency that, when the actuator is moved (turned) to the "working position (closed position)", the pressing force applied from the actuator is applied to the contact members in a state in which the pressing force is dispersed in the multipolar arrangement direction of the contact members. For example, Japanese Patent Application Laid-Open No. 2005-251760 discloses a configuration in which a pressurizing portion 15A provided on a pressurizing member 15 strongly presses a flat cable C toward contact portions 12 and electrically connect them. However, the pressurizing portion 15A, which pressurizes them, is in a positional relation that it is shifted in a multipolar arrangement direction with respect to the contact portions 12 and electrically-conductive paths provided on the flat cable C. Therefore, the state of contact between the electrically-conductive paths provided on the signal transmission medium and the contact portions of the contact members may become unstable. Furthermore, if unexpected external force is applied to the signal transmission medium (FPC, FFC, or the like), it is conceivable that the signal transmission medium may be separated from the contact members. Particularly, in recent years in which electric connectors are downsized and thinned, the above described state of contact between both of the members is required to be more reliably maintained.

We disclose prior patent documents as follows.

1. Japanese Patent Application Laid-Open No. 2005-251760
2. Japanese Patent Application Laid-Open No. 1995 (H07)-142130

SUMMARY OF THE INVENTION

Therefore, it is an object of the present invention to provide an electric connector capable of, by a simple configuration, maintaining the state of contact between a signal transmission medium (FPC, FFC, or the like) and contact members well and reliably maintaining the state of contact between both of the members even if unexpected external force is applied to the signal transmission medium.

In order to achieve the above described object, the present invention employs a configuration of an electric connector configured to move an actuator to a working position in a state in which a first-side surface of a signal transmission medium is disposed to face contact portions of a plurality of contact members arranged so as to form a multipolar shape, thereby bringing medium pressing portions provided on the actuator into pressure-contact with a second-side surface of the signal transmission medium and electrically connecting the contact portions of the contact members with the signal transmission medium; wherein the plurality of medium pressing portions of the actuator are provided at a predetermined interval therebetween in a direction of the multipolar arrangement; the medium pressing portions are disposed at same positions as the contact portions of the contact members, respectively, in the direction of the multipolar arrangement; and, when the actuator is moved to the working position, the medium pressing portions of the actuator and the contact portions of the contact members are disposed so as to be directly opposed to each other.

According to the present invention having such a configuration, when the actuator is moved to the working position, the medium pressing portions of the actuator at the positions directly opposed to the contact portions of the contact members press the signal transmission medium, and the contact pressures applied from the medium pressing portions of the actuator to the signal transmission medium are reliably applied to the contact portions of the contact members without being dispersed.

Moreover, in the present invention, it is desired that a groove portion be provided to be recessed on an intermediate part between the medium pressing portions of the actuator mutually adjacent in the direction of the multipolar arrangement; and, in a state in which the actuator is moved to the working position, the groove portion be configured to be in a state in which the groove portion is not in contact with the surface of the signal transmission medium.

According to the present invention having such a configuration, only the medium pressing portions of the actuator are brought into pressure-contact with the first-side surface of the signal transmission medium, and the contact pressures of the contact portions of the contact members opposed to the medium pressing portions of the actuator are more reliably applied to the signal transmission medium.

Furthermore, it is desired that the medium pressing portion of the actuator of the present invention be provided with a deformation allowing portion that houses an elastically deformed part of the signal transmission medium when the contact portion of the contact member is brought into pressure-contact with the signal transmission medium.

According to the present invention having such a configuration, the elastically deformed part of the signal transmission medium generated by pressing by the medium pressing portion of the actuator is housed in the deformation allowing portion, thereby causing the signal transmission medium to be in a latched state, and the retaining characteristic of the signal transmission medium is improved.

Furthermore, the actuator may be provided with a shaft portion extending along the direction of the multipolar arrangement; and the contact member may be provided with a bearing portion that turnably supports the shaft portion of the actuator.

On the other hand, in the present invention, it is desired that the actuator be provided with a bearing housing portion consisting of a space that houses the bearing portion of the contact member; and the medium pressing portion of the actuator be disposed at a same position as the bearing housing portion in the direction of the multipolar arrangement.

According to the present invention having such a configuration, the part including the bearing portion of the contact member is structured to be housed in the bearing housing portion of the actuator. Therefore, the entire electric connector is downsized.

Moreover, it is desired that the bearing housing portion of the actuator of the present invention be communicated with a deformation allowing portion.

According to the present invention having such a configuration, when a mold(s) for producing the actuator is formed, the structure of the mold that forms the bearing housing portion and the shaft portion is easily mold-released through the part corresponding to the deformation allowing portion, and productivity is improved.

As described above, the electric connector according to the present invention is configured to dispose the medium pressing portions of the actuator, which is subjected to the moving operation so as to electrically connect the contact portions of the plurality of contact members arranged so as to form a multipolar shape and the signal transmission medium (FPC, FFC, or the like) to each other, at the same positions as the contact portions of the contact members in the direction of the multipolar arrangement so that, when the actuator is moved to the working position, the medium pressing portions of the actuator at the positions directly opposed to the contact portions of the contact members press the signal transmission medium, and the contact pressures applied from the medium pressing portions of the actuator to the signal transmission medium are reliably applied to the contact portions of the contact members without being dispersed. Therefore, by a simple configuration, the state of contact between the signal transmission medium and the contact members is maintained well, the contact state between both of the members can be reliably maintained even when unexpected external force is applied to the signal transmission medium, and the quality and reliability of the electric connector can be significantly improved at low cost.

DETAILED DESCRIPTION OF THE PREFERRED EMBODIMENT

Hereinafter, in order to connect a signal transmission medium consisting of a flexible printed circuit (FPC), a flexible flat cable (FFC), or the like, an embodiment in which the present invention is applied to an electric connector, which is mounted and used on a printed wiring substrate, will be explained in detail based on drawings.

[About Overall Structure of Electric Connector]

An electric connector 10 according to an embodiment of the present invention shown in FIG. 1 to FIG. 6 is an electric connector having a so-called front-flip-type structure, in which an actuator 12 serving as a connection operating means is attached to a front edge part (right edge part in FIG. 6) of an insulating housing 11. The above described actuator (connection operating means) 12 is in a state in which it is turned so as to be pushed down toward a connector front end side (right end side in FIG. 6) to which a terminal part of a signal transmission medium (FPC, FFC, or the like) F is inserted.

The insulating housing 11 herein is formed of an insulating member having a hollow frame shape extending in a thin and long shape. The longitudinal direction of the insulating housing 11 will be hereinafter referred to as "connector longitudinal direction", the terminal part of the signal transmission medium (FPC, FFC, or the like) F is assumed to be inserted from "connector front side" toward "connector rear side", and the inserting direction of the signal transmission medium F will be referred to as "medium inserting direction". Furthermore, the terminal part of the signal transmission medium F is assumed to be removed from "connector rear side" toward "connector front side", and the removing direction of the signal transmission medium F will be referred to as "medium removing direction".

As contact members formed by thin-plate-shaped metal members having appropriate shapes, a plurality of electrically-conductive contacts 13 are attached to an inner part of the insulating housing 11. The plurality of electrically-conductive contacts 13 are disposed so as to form multipolar shapes at appropriate intervals therebetween along the connector longitudinal direction, and the electrically-conductive contacts 13 are configured to be used in a state in which they are mounted by solder-joining on electrically-conductive paths (illustration omitted), which are formed on a printed wiring substrate B (see FIG. 10, FIG. 12, and FIG. 14), for signal transmission or for ground connection.

Figure 1:
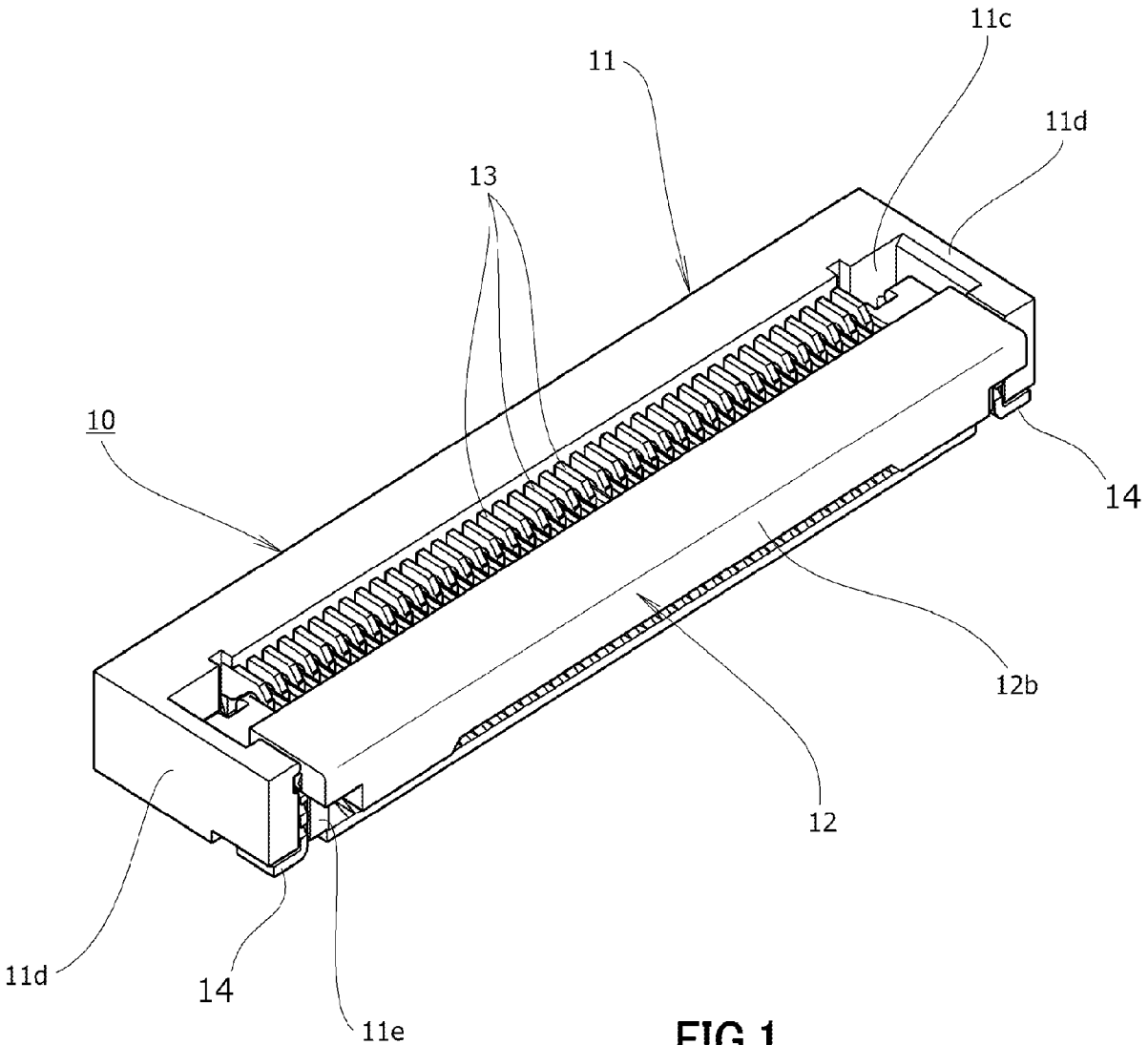
FIG. 1 is an explanatory external perspective view showing an electric connector according to an embodiment of the present invention and showing, from a front side, an overall configuration of a case in which an actuator is down to a working position (closed position) when a signal transmission medium is in a not inserted state.
Figure 2:
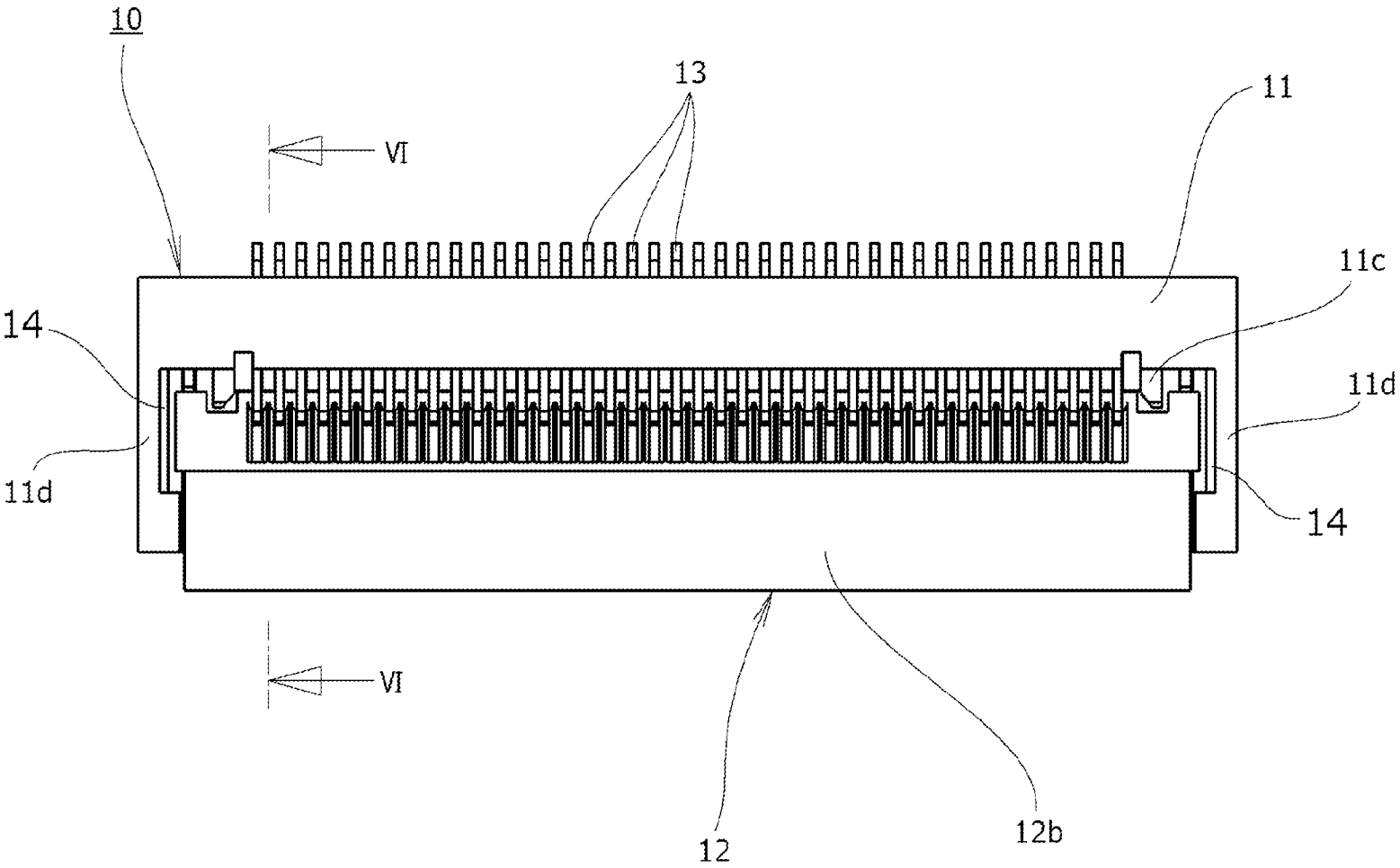
FIG. 2 is an explanatory plan view of the electric connector in the closed position shown in FIG. 1.
Figure 3:
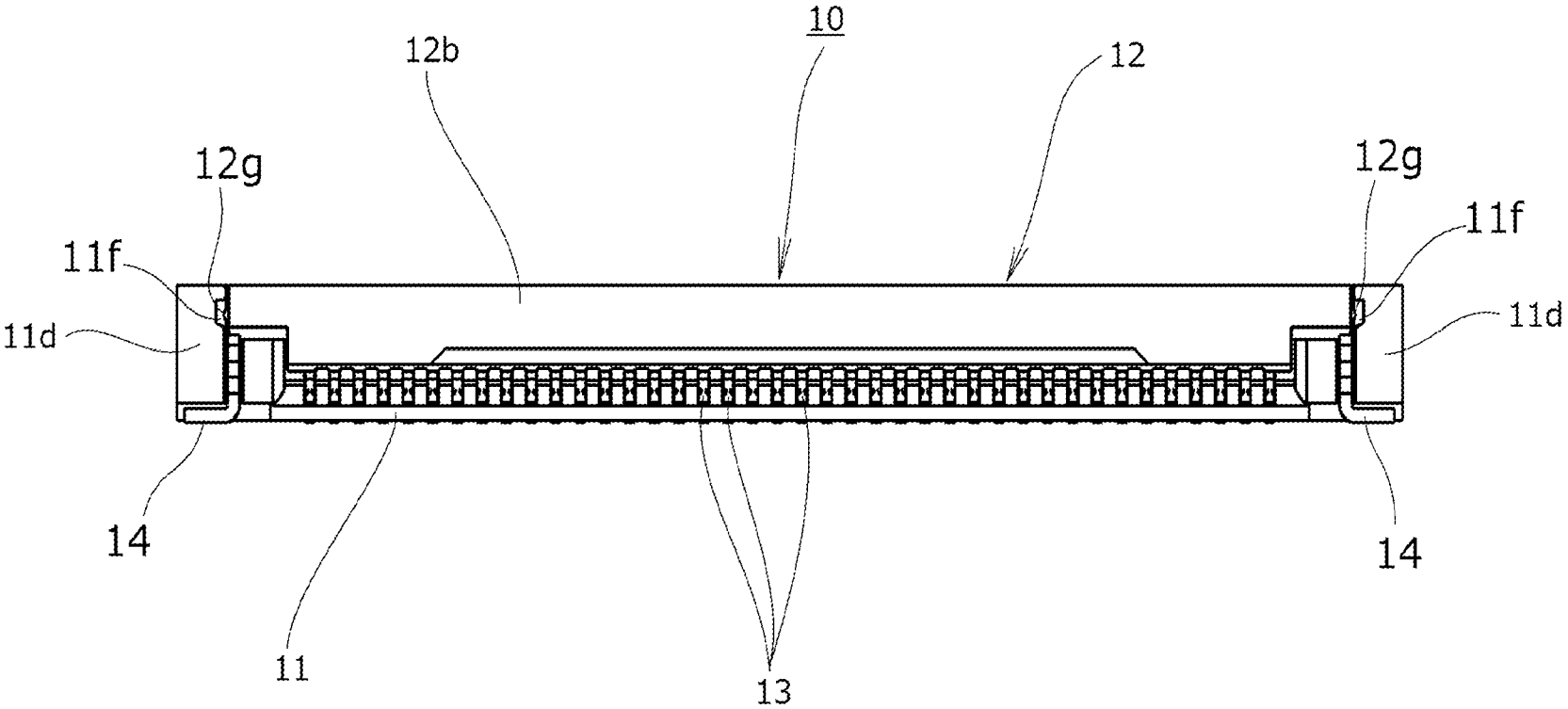
FIG. 3 is an explanatory plan view of the electric connector in the closed state shown in FIG. 1 and FIG. 2.
Figure 4:
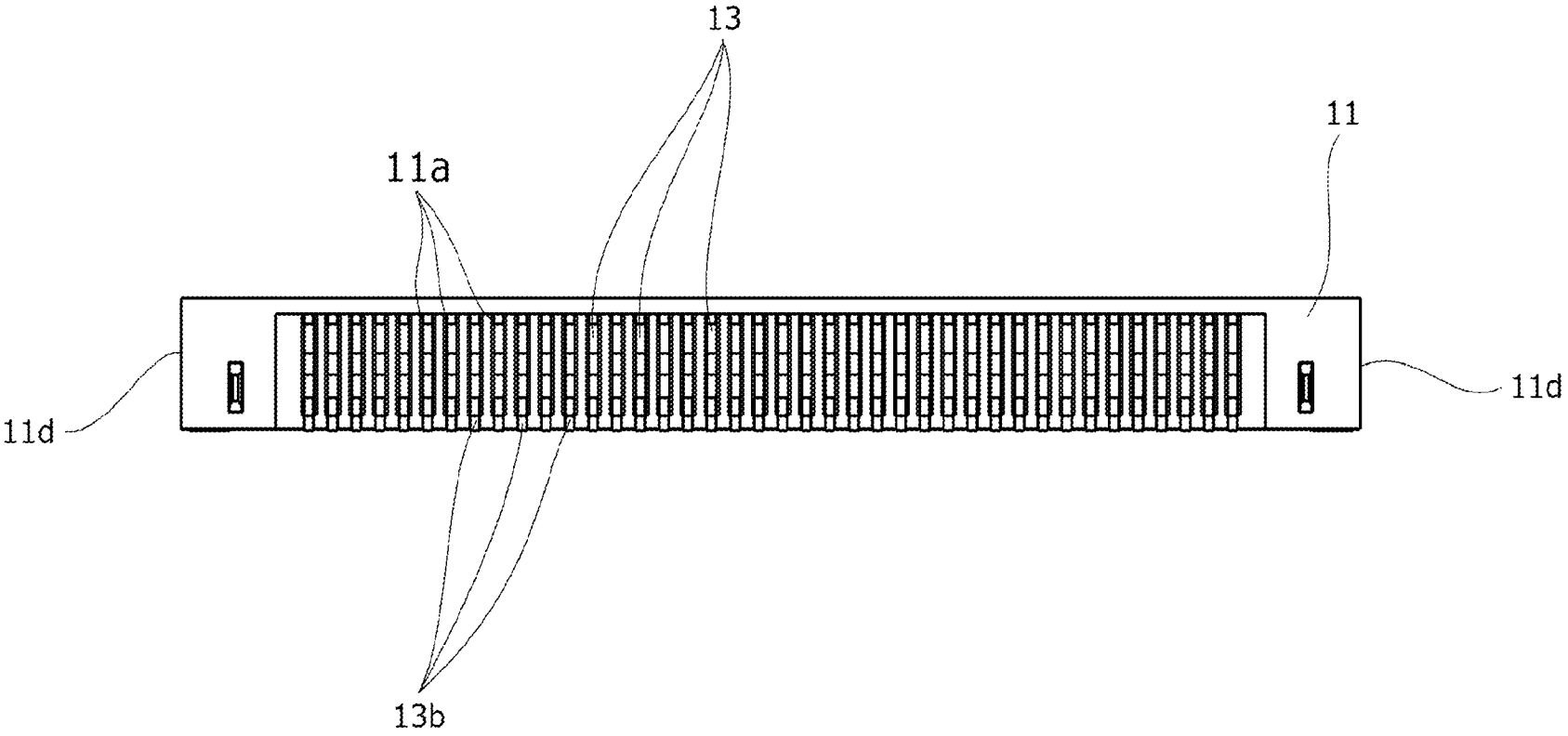
FIG. 4 is an explanatory back view of the electric connector in the closed state shown in FIG. 1 to FIG. 3.
Figure 5:
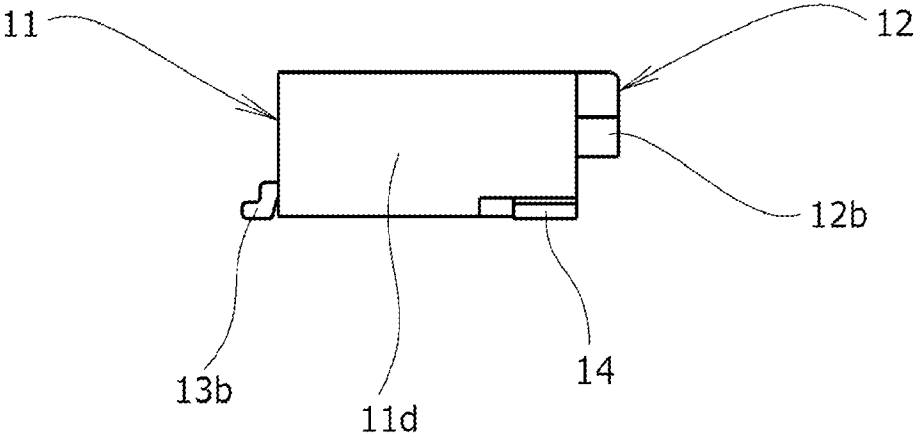
FIG. 5 is an explanatory lateral view of the electric connector in the closed state shown in FIG. 1 to FIG. 4.
Figure 6:
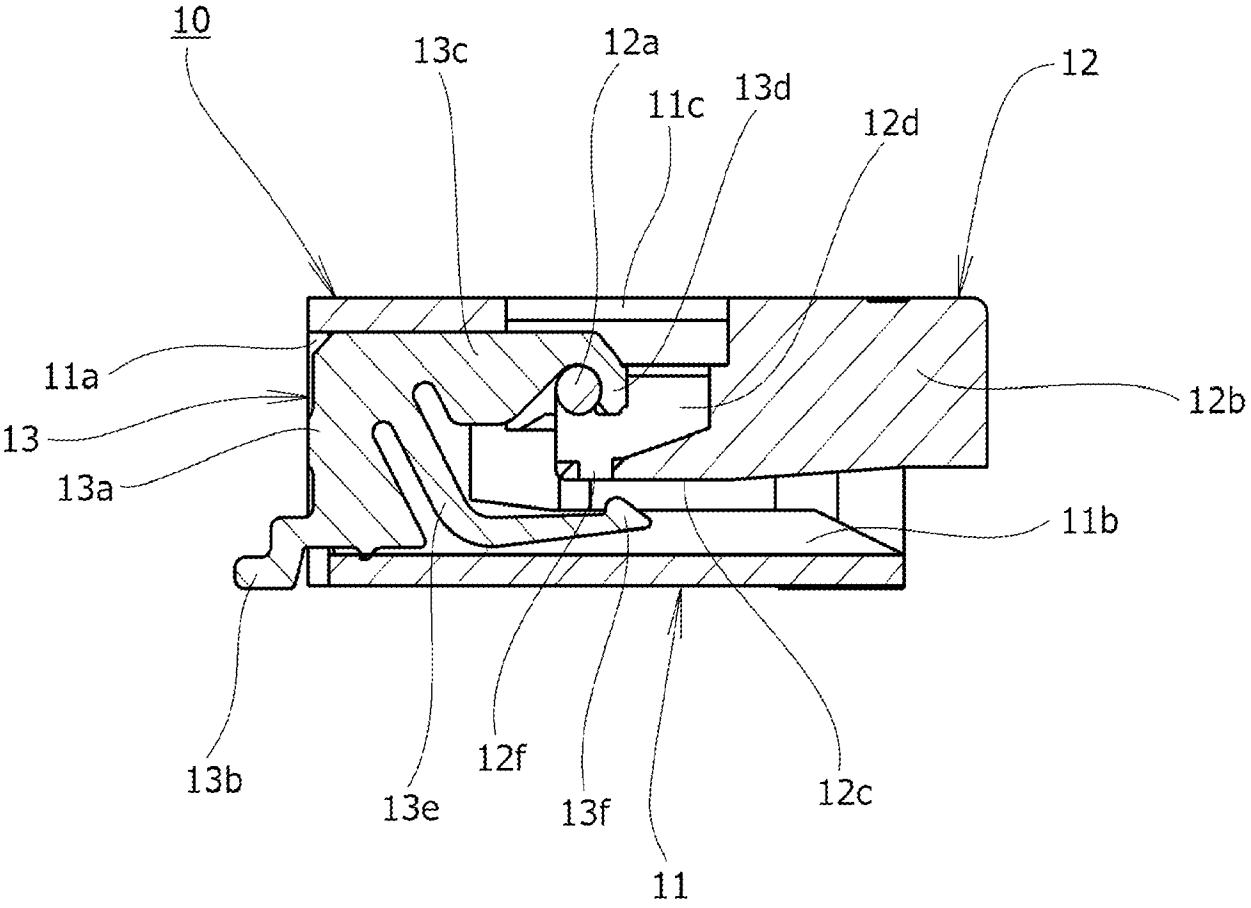
FIG. 6 is an explanatory view showing, in an enlarged manner, a transverse cross section taken along a line VI-VI in FIG. 2.
Figure 7:
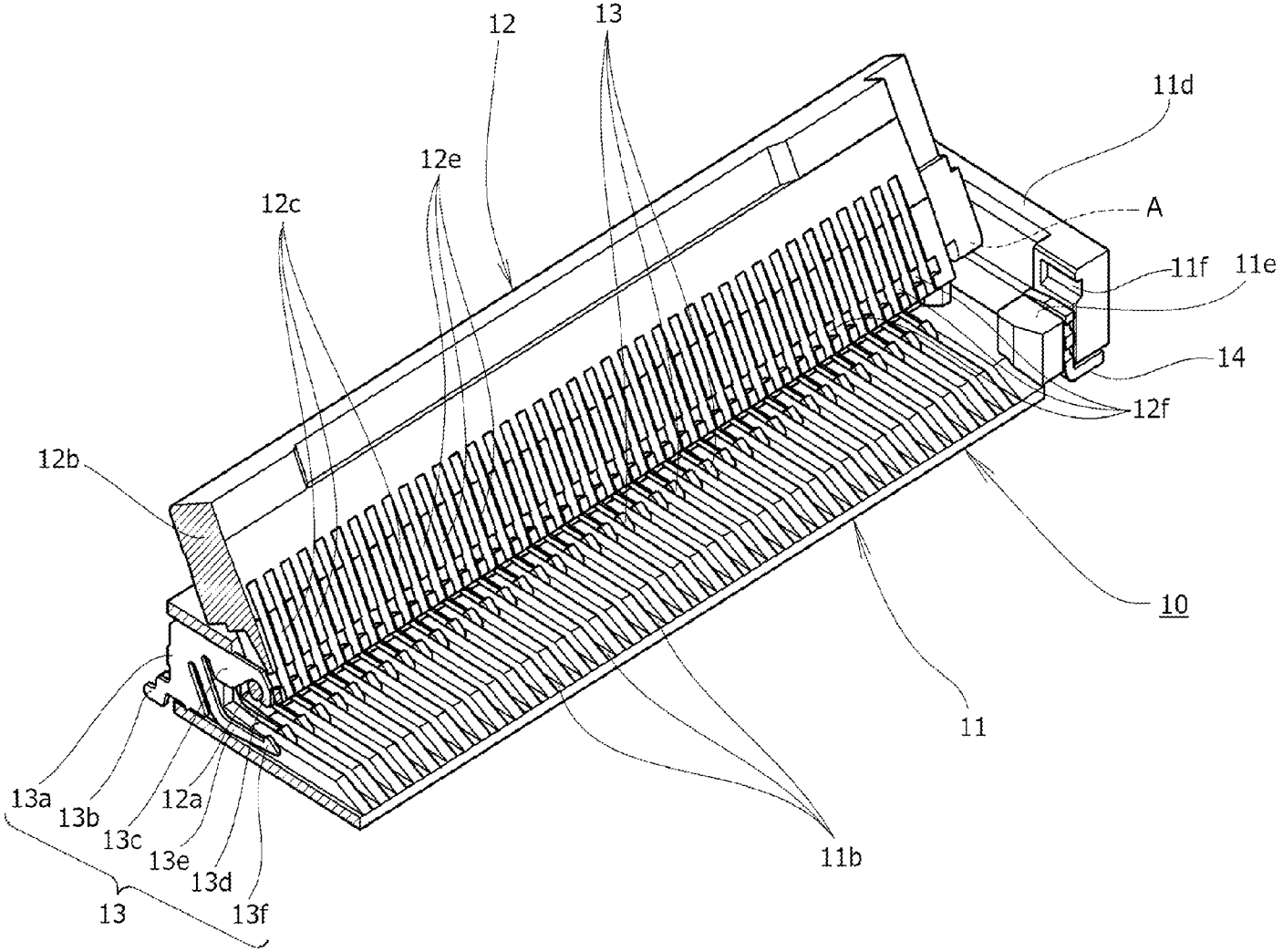
FIG. 7 is an explanatory external perspective view showing, from the front side, the overall configuration of a state in which the actuator of the electric connector shown in FIG. 1 to FIG. 6 is flipped up to a stand by position (opened position) and showing a partial cross section.

The actuator 12 serving as the connection operating means is attached to the front edge part (right edge part in FIG. 6) of the insulating housing 11 as described above, and the actuator 12 is configured to be subjected to a turning operation so as to be lifted up to the upper side as shown in FIG. 7 and thereafter. When the actuator 12 is subjected to the turning operation to the upper side in such a manner, the front edge part of the insulating housing 11 is brought into an opened state across approximately the entire length of the connector longitudinal direction. Then, the terminal part of the signal transmission medium F consisting of a flexible printed circuit (FPC), a flexible flat cable (FFC), or the like is inserted from the front edge part of the insulating housing 11, which is in the opened state, into the insulating housing 11.

Furthermore, at a rear edge part (left edge part in FIG. 6) of the insulating housing 11, a plurality of part attachment openings 11*a* for attaching the above described electrically-conductive contacts (contact members) 13, etc. are provided so as to be juxtaposed at a certain interval along the connector longitudinal direction. The electrically-conductive contacts (contact members) 13, which are inserted from the part attachment openings 11*a* into the insulating housing 11, are fixed when the electrically-conductive contacts are inserted so as to slide along contact attachment grooves 11*b*, which are provided so as to be recessed on upper/lower inner wall surfaces forming interior space of the insulating housing 11.

The above described plurality of electrically-conductive contacts (contact members) 13 are attached so as to form multipolar shapes in the connector longitudinal direction, and the electrically-conductive contacts 13 are disposed at the positions corresponding to wiring patterns (illustration omitted) of the signal transmission medium (FPC, FFC, or the like) F, which is inserted from the connector front side into the insulating housing 11. The wiring patterns formed on the signal transmission medium F are signal-transmitting electrically-conductive paths (signal line pads) or shielding electrically-conductive paths (shield line pads) disposed at appropriate pitch intervals.

[About Contact Members]

Herein, each of the above described electrically-conductive contacts (contact members) 13 has a rear-end base portion 13*a*, which is fixed so as to be sandwiched by the inner wall surfaces of upper/lower wall portions forming the part attachment opening 11*a* of the insulating housing 11. At a lower end portion of the rear-end base portion 13*a*, a substrate connecting portion 13*b* extending so as to form a step shape toward the outer side of the connector rear side is provided. The substrate connecting portion 13*b* is connected to the electrically-conductive path (illustration omitted) on the printed wiring substrate B (see FIG. 10, FIG. 12, and FIG. 14) by solder joining, and the electric connector 1 is mounted thereon by the solder joining.

Furthermore, a supporting beam 13*c* is approximately horizontally extending toward the connector front side from an upper end part of the rear-end base portion 13*a* constituting the above described each electrically-conductive contact (contact member) 13. The supporting beam 13*c* is extending to an approximately central part in a connector front-rear direction in a state in which the supporting beam 13*c* is abutting the inner surface of the upper wall portion, which forms the interior space of the insulating housing 11. The extending end part of the supporting beam 13*c* is exposed to the upper side through a central opening 11*c*, which is provided in the insulating housing 11.

More specifically, the central opening 11*c* of the above described insulating housing 11 is formed so as to cut away the part of the upper wall portion of the insulating housing 11 that is in the front side of the connector-front-rear-direction central part, and the central opening 11*c* is provided along the entire length excluding lateral wall portions 11*d* and 11*d* provided at connector-longitudinal-direction both end portions. In the front-side region of the central opening 11*c*, the above described actuator (connection operating means) 12 is disposed; and, in a rear-side region of the central opening 11*c*, a front-end-side part of the supporting beam 13*c* constituting the electrically-conductive contact 13 as described above is disposed so as to be exposed to the upper side.

Latch receiving portions 11*f* having recessed shapes are formed in front end parts of the lateral wall portions 11*d* and 11*d* of the insulating housing 11. The actuator 12 is configured to be maintained in a state in which it is pushed down like FIG. 1 to FIG. 6 when part of the later-described actuator 12 is latched with respect to the latch receiving portions 11*f*. This point will be explained later in detail.

Herein, in a front end portion of the supporting beam 13*c*, a bearing portion 13*d* is formed so as to be opened toward the lower side and form a recessed shape. A turning shaft 12*a* serving as a shaft portion provided at the actuator (connection operating means) 12 is disposed so as to slidably contact the bearing portion 13*d*, which is provided at the supporting beam 13*c*, from the lower side, and the actuator 12 is configured to be turned about the turning shaft (shaft portion) 12*a*. The configuration of the actuator 12 will be explained later in detail.

Furthermore, an elastic beam 13*e* is provided so as to be branched from an integrally coupled part of the upper end part of the rear-end base part 13*a*, which is constituting the rear end part of each of the electrically-conductive contact (contact member) 13, and a root part of the supporting beam 13*c*. The elastic beam 13*e* is formed by a band-plate-shaped flexible member which is extending from a lower edge of the root part of the above described supporting beam 13*c* toward an obliquely lower side of the connector front side so as to form a cantilever shape, and the elastic beam 13*e* is extending obliquely downward to a vicinity of the inner wall surface of the lower wall portion of the insulating housing 11 and is then extending approximately linearly toward the connector front side so as to be somewhat bent upward. Then, at an extending-side front end part of the elastic beam 13*e*, a contact portion 13*f* is formed so as to form an upward projection shape.

The contact portion 13*f* provided in the elastic beam 13*e*, which forms part of the electrically-conductive contact (contact member) 13, is in a disposition relation in which the contact portion 13*f* faces the wiring pattern (illustration omitted) of the signal transmission medium (FPC, FFC, or the like) F, which is inserted in the insulating housing 11, from the lower side. Then, when the signal transmission medium F is pressed by the actuator (connection operating means) 12, which has been subjected to the turning operation, the wiring pattern of the signal transmission medium F is pressed against the contact portion 13*f* of the electrically-conductive contact 13 from the upper side.

[About Actuator]

Herein, the actuator (connection operating means) 12, which is subjected to the turning operation about the turning shaft 12*a* of itself as described above, has an operation main-body portion 12*b*, which consists of a plate-shaped member extending in the connector longitudinal direction. More specifically, the operation main-body portion 12*b* is provided with a pair of both edge portions extending in the connector longitudinal direction; wherein, the above described turning shaft 12*a* serving as the shaft portion is extending so as to be along the edge portion of a first side among them, and the turning operation force of an operator is configured to be applied to an outer-side part of the turning radius having the turning shaft (shaft portion) 12*a* as the center thereof.

Herein, both end parts of the above described turning shaft 12*a* are formed in a state in which they are projecting from the connector-longitudinal-direction both end surfaces of the operation main-body portion 12*b* toward the outer side (not shown in the drawings since they are hidden by an Apart of FIG. 7). The turning shaft 12*a* is supported so as not to fall from the bearing portions 13*d* of the electrically-conductive contacts 13 since the both end parts of the turning shaft 12*a* are supported by upper rim portions of retaining metal fittings 14, which are disposed along the inner surface side of the lateral wall portions 11*d* and 11*d* of the insulating housing 11. The lower end parts of the retaining metal fittings 14 are placed on the illustration-omitted printed wiring substrate and mounted thereon by solder joining.

Furthermore, latching portions 12*g* (see FIG. 8 and FIG. 9), which are formed so as to form projection shapes toward the connector-longitudinal-direction outer sides, are provided at front end parts of the operation main-body portion 12*b* in a state in which the actuator (connection operating means) 12 is horizontally pushed down. The latching portions 12*g* provided on the actuator 12 are configured to be mated with the latch receiving portions 11*f* in the side of the insulating housing 11 when the actuator (connection operating means) 12 is turned so as to be horizontally pushed down. When both of the members 12*g* and 11*f* are mated with each other, the actuator 12 is maintained in the horizontally pushed down state (see FIG. 1 to FIG. 6).

Figure 8:
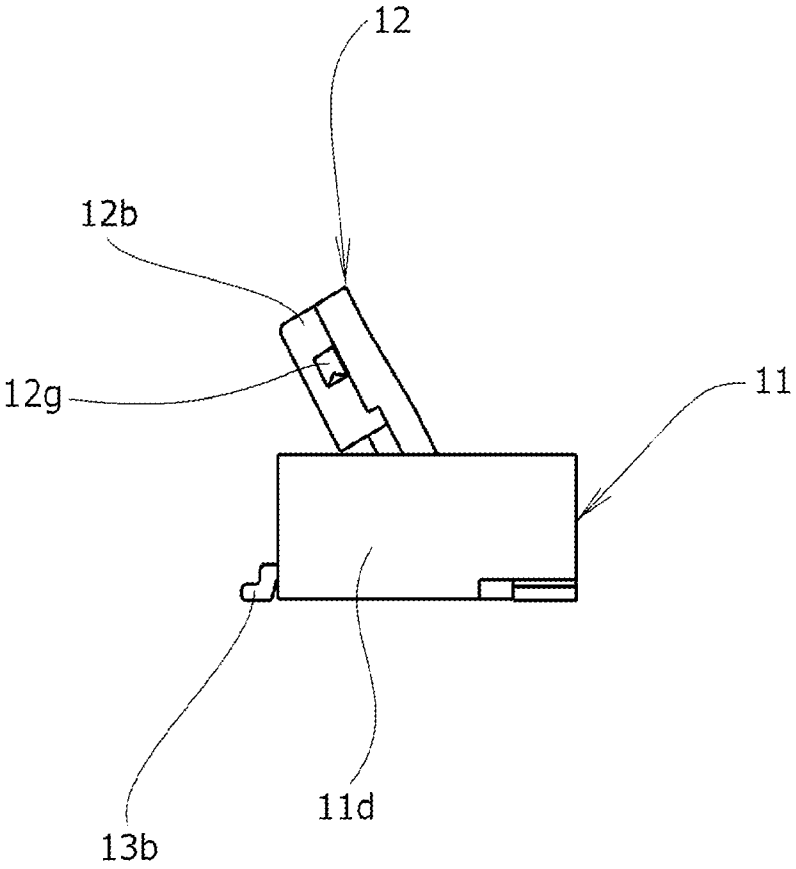
FIG. 8 is an explanatory lateral view of the electric connector in the opened state shown in FIG. 7.

More specifically, the actuator (connection operating means) 12 in the horizontally pushed down state is disposed so as to cover the front-side region of the central opening 11*c* of the above described insulating housing 11, and the actuator 12 is configured so as to be subjected to the turning operation from the horizontally pushed down "working position (closed position)" to "standby position (opened position)" lifted up to the upper side as shown in FIG. 7 and FIG. 8. The actuator 12 which has been subjected to the turning operation to the "standby position (opened position)" is configured to abut part of the insulating housing 11 and stop turning in a state in which it is tilted somewhat to the rear side after an upright state.

Figure 9:
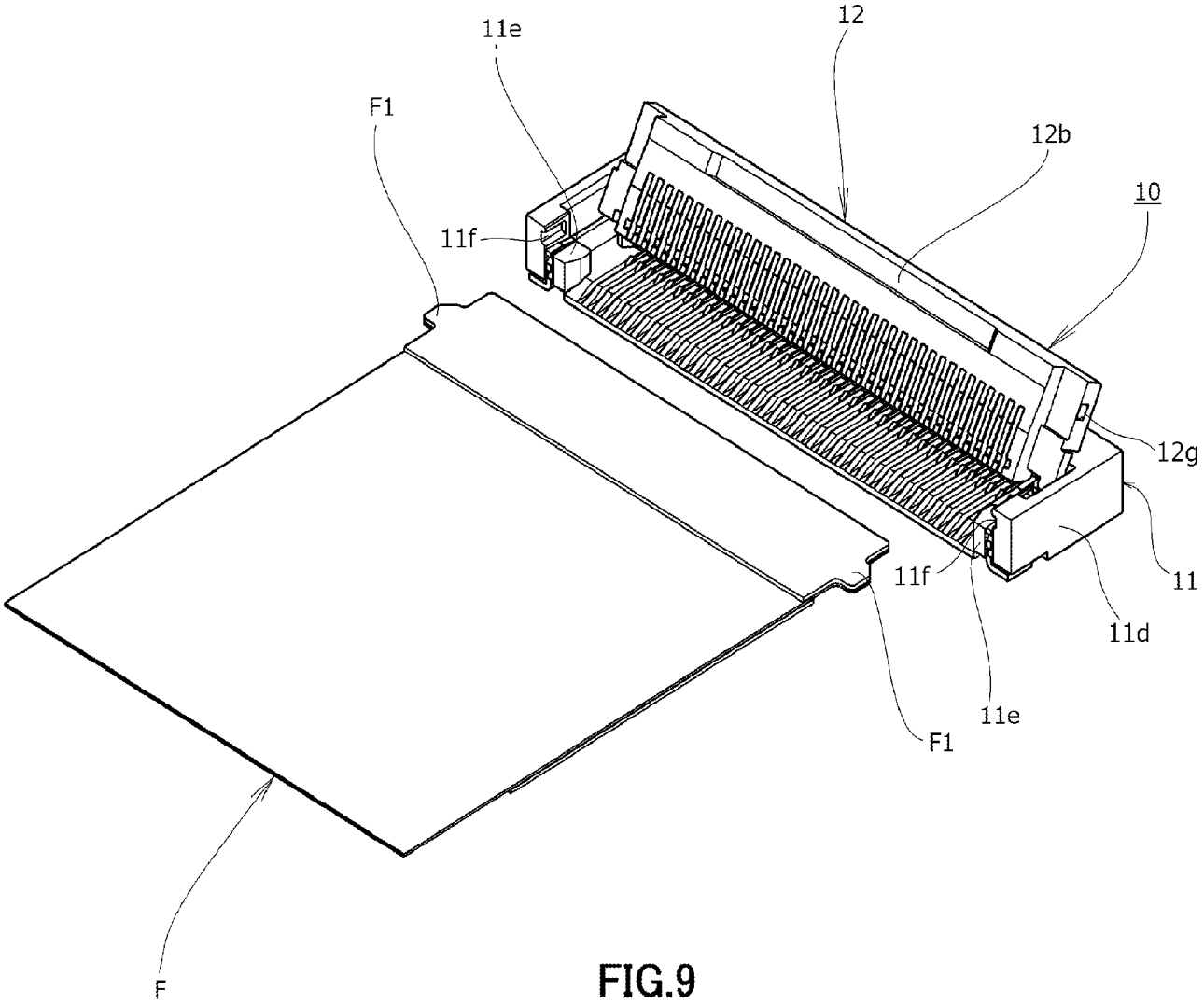
FIG. 9 is an explanatory external perspective view showing a state in which a terminal part of the signal transmission medium is brought to the vicinity of an insertion start position with respect to the electric connector, which is in the opened state shown in FIG. 7 and FIG. 8.
Figure 10:
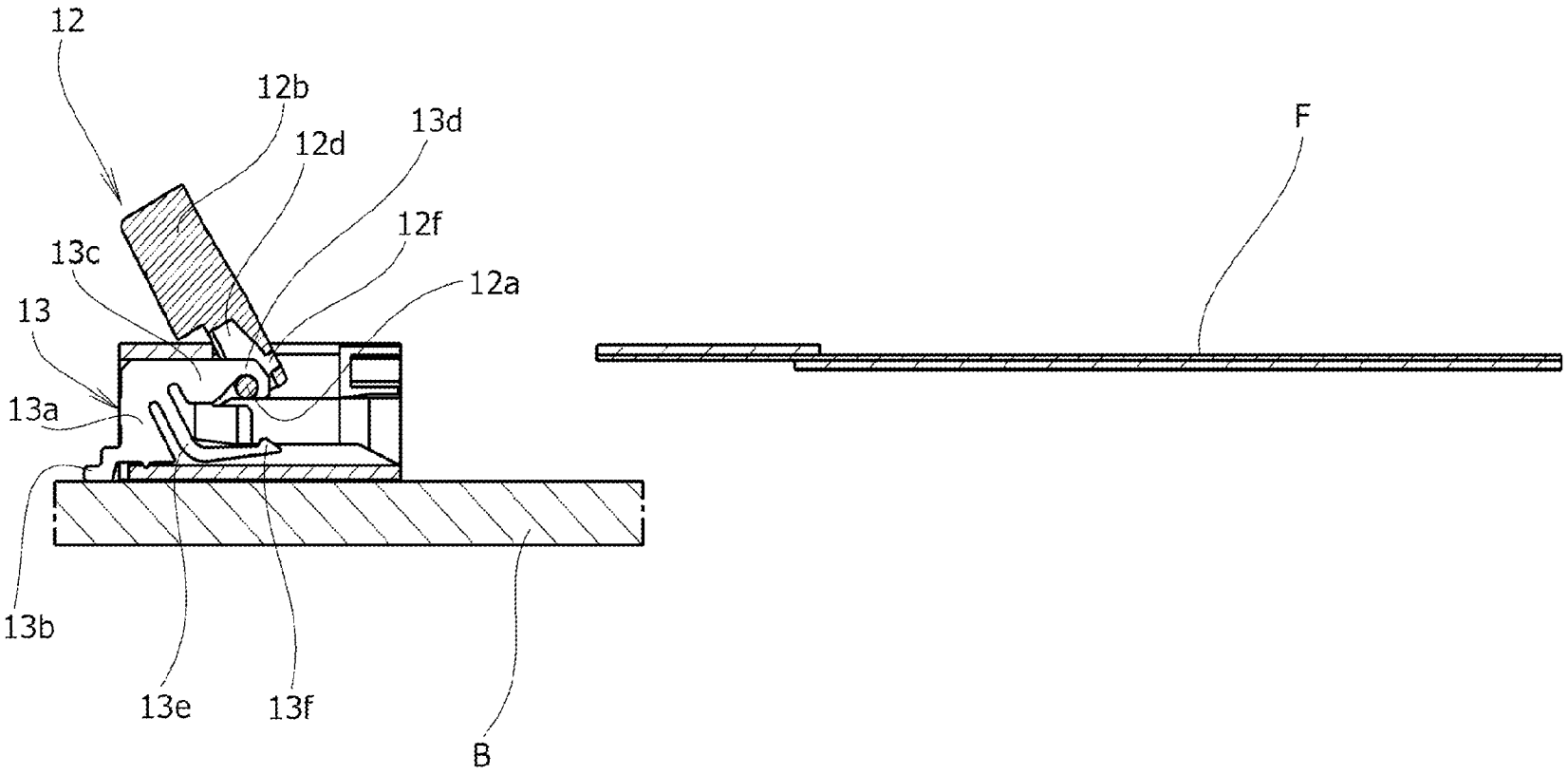
FIG. 10 is an explanatory transverse cross-sectional view corresponding to FIG. 6 showing the electric connector and the signal transmission medium, which are in the positional relation shown in FIG. 9.

When the actuator (connection operating means) 12 is subjected to the turning operation in this manner so as to be lifted to the "standby position (opened position)", a front-end-side region of the insulating housing 11 is brought into an upward opened state, and the terminal part of the signal transmission medium (FPC, FFC, or the like) F is configured to be disposed in the vicinity of the front-end-side region of the insulating housing 11, which is in the opened state, and be placed thereon from the upper side as shown in FIG. 9 and FIG. 10.

Figure 11:
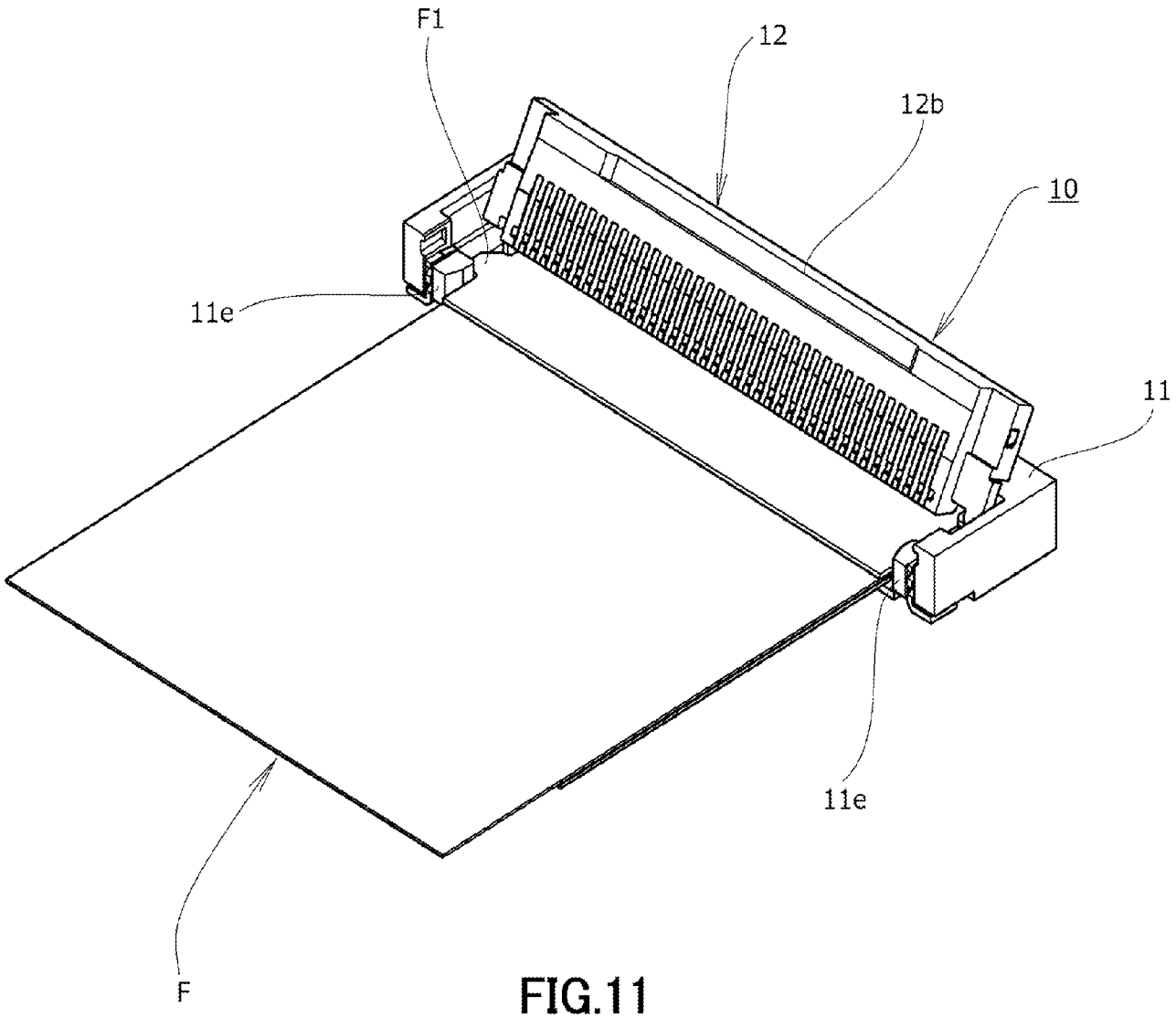
FIG. 11 is an explanatory external perspective view showing a state in which the terminal part of the signal transmission medium is inserted in the electric connector after the state shown in FIG. 9.
Figure 12:
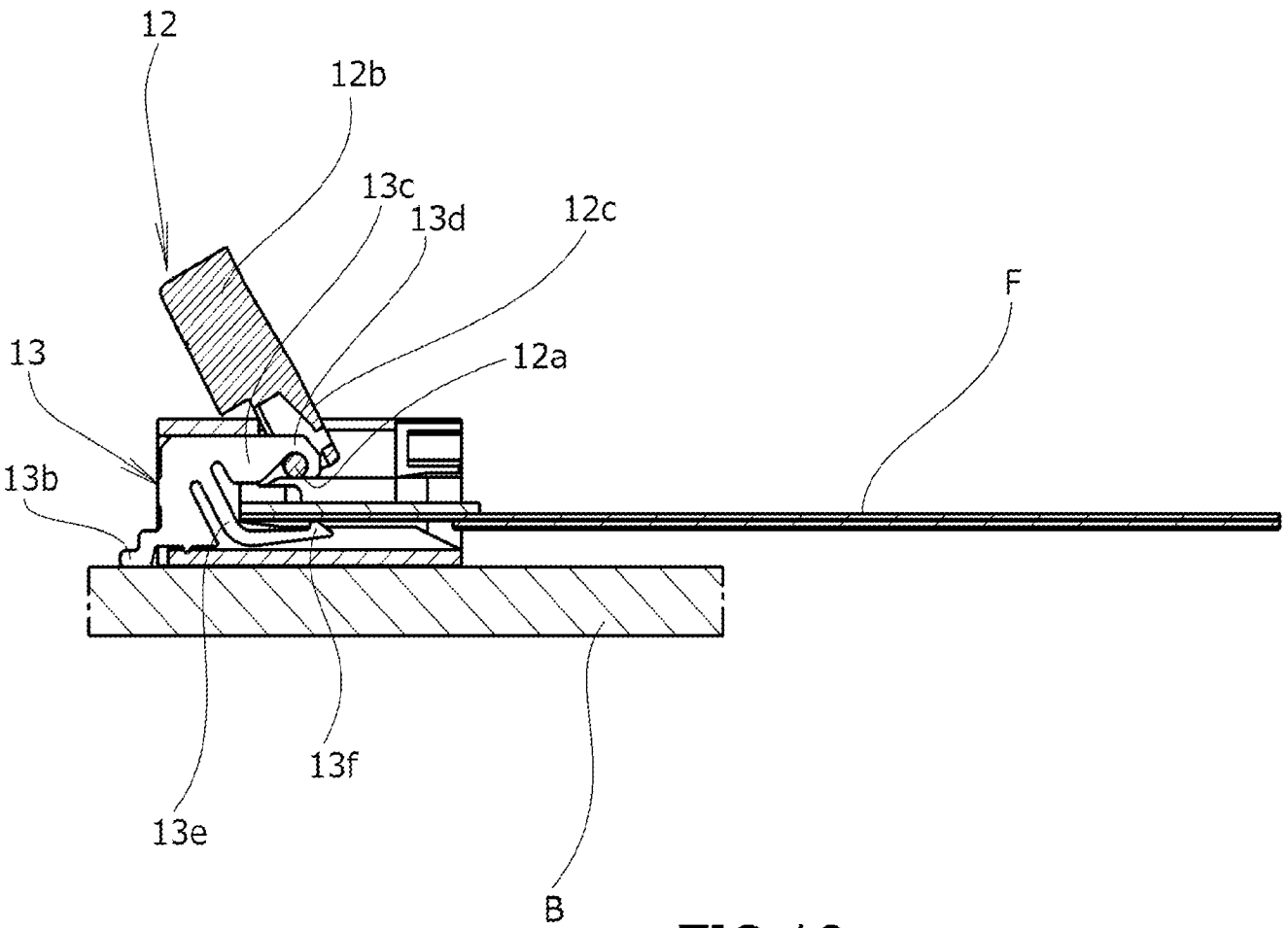
FIG. 12 is an explanatory transverse cross-sectional view corresponding to FIG. 6 showing the electric connector and the signal transmission medium in the positional relation shown in FIG. 11.
Figure 16:
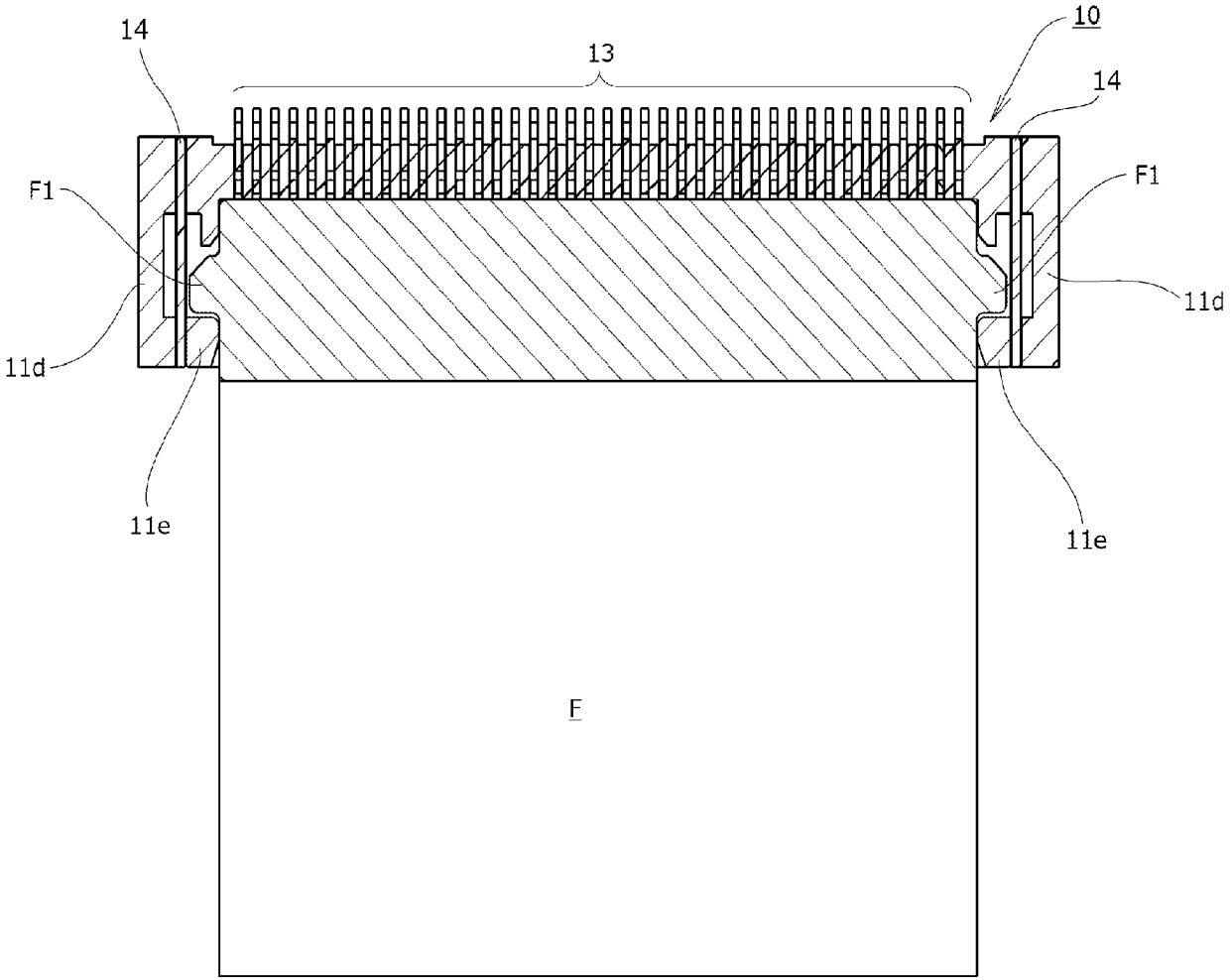
FIG. 16 is an explanatory transverse cross-sectional view taken along a line XVI-XVI in FIG. 15.

Then, the terminal part of the signal transmission medium (FPC, FFC, or the like) F, which is placed on the front-end-side region of the insulating housing 11 in the above described manner, is inserted toward the connector front side (left side in FIG. 10) and is stopped in a state in which it is abutting the wall portion of the insulating housing 11 as shown in FIG. 11 and FIG. 12. Herein, particularly as shown in FIG. 9, FIG. 11, and FIG. 16, positioning and latching plates F1 and F1 are provided at both-side edge portions of the terminal part of the signal transmission medium F so as to project to the both-side outer sides. Positioning of the signal transmission medium F is configured to be carried out when movement of the positioning and latching plates F1 and F1 in the extending direction of the signal transmission medium F is regulated by lock plates 11*e* and 11*e*, which are disposed at longitudinal-direction both-side parts of the insulating housing 11 so as to be opposed to each other.

Figure 13:
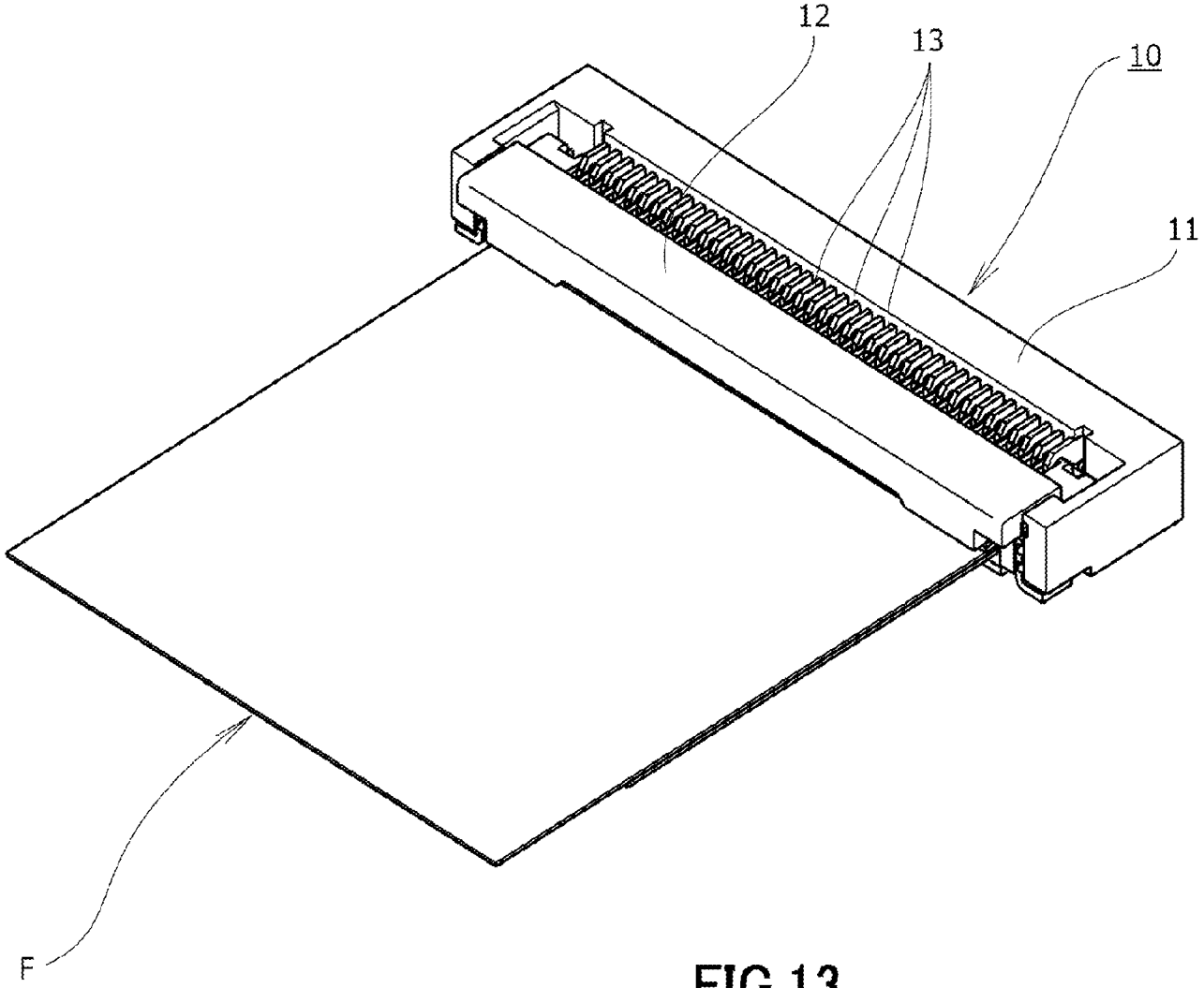
FIG. 13 is an explanatory external perspective view showing a state in which the actuator is pushed down to the working position (closed position) after the state shown in FIG. 11.
Figure 14:
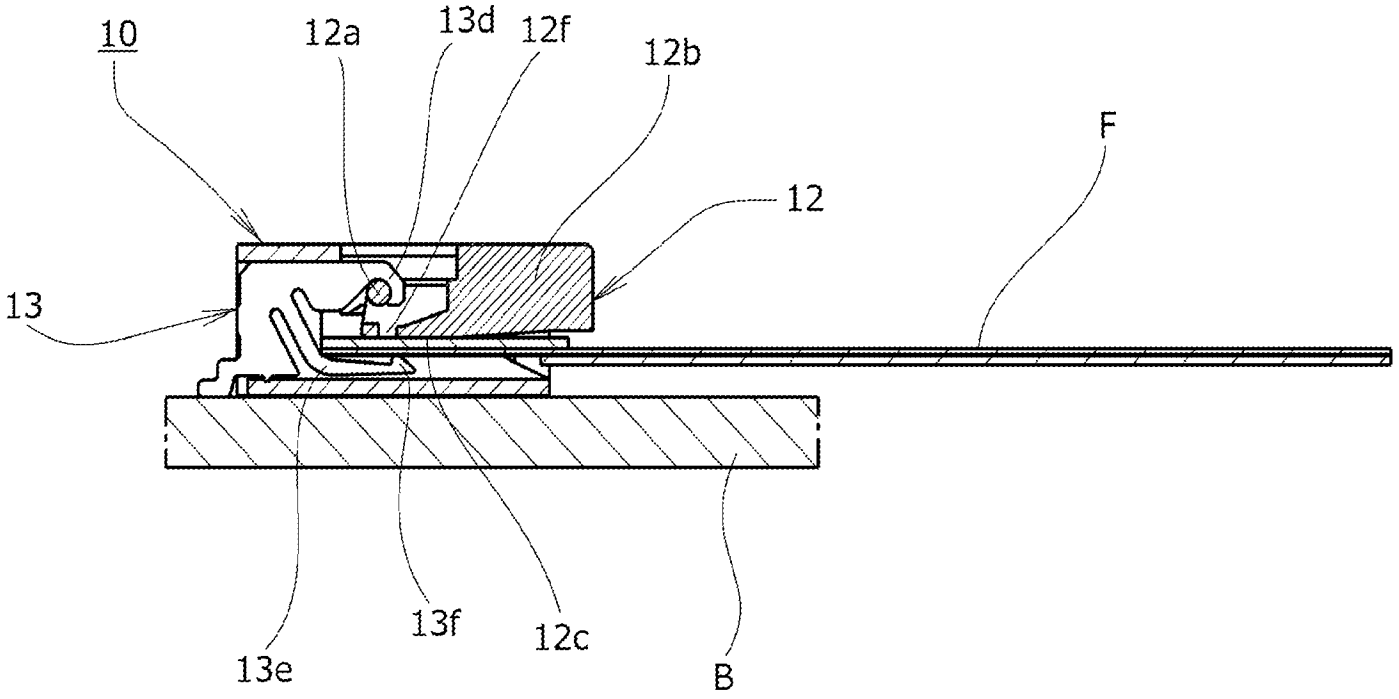
FIG. 14 is an explanatory transverse cross-sectional view corresponding to FIG. 6 showing the electric connector and the signal transmission medium, which are in the positional relation shown in FIG. 13.

Then, when the actuator (connection operating means) 12, which had been at the "standby position (opened position)", is subjected to the turning operation so as to be pushed down to the connector front side, the actuator 12 is moved (turned) to the "working position (closed position)" as shown in FIG. 13 and FIG. 14, and the latching portions 12*g*, which are provided on the operation main-body portion 12*b* so as to form the projection shapes as described above, are latched by the latch receiving portions 11*f* of the insulating housing 11 and retained at the "working position (closed position)".

Medium pressing portions 12*c* are formed in a later described manner on a surface corresponding to the lower surface of the actuator (connection operating means) 12 moved (turned) to the "working position (closed position)". The medium pressing portions 12*c* are configured to press the upper surface (first-side surface) of the signal transmission medium (FPC, FFC, or the like) F toward the lower side and push the wiring patterns, which are provided on the signal transmission medium F, against the contact portions 13*f* of the electrically-conductive contacts (contact members) 13. This point will be explained later in detail.

A plurality of bearing housing portions 12*d* consisting of spaces which house the bearing portions 13*d* of the supporting beams 13*c*, which are part of the above described electrically-conductive contacts (contact members) 13, are provided to be recessed on the operation main-body portions 12*b* of the actuator (connection operating means) 12 as shown in FIG. 6 so as to form comb teeth shapes. Each of the bearing housing portions 12*d* is disposed at the same position as the above described electrically-conductive contact 13 in the connector longitudinal direction (multipolar arrangement direction) and is disposed so that the bearing portion 13*d* of the supporting beam 13*c* is inserted in the bearing housing portion 12*d* of the actuator 12. As described above, the turning shaft 12*a* of the actuator (connection operating means) 12 is disposed to be in contact with the bearing portion 13*d* of the supporting beam 13*c* so as to be pressed thereagainst from the lower side, and the actuator 12 is therefore configured to be turnably retained.

On the other hand, the plurality of medium pressing portions 12*c*, which press the upper surface (first-side surface) of the signal transmission medium (FPC, FFC, or the like) F, are formed on the operation main-body portion 12*b* of the actuator (connection operating means) 12 as described above. The plurality of medium pressing portions 12*c* are formed on the surface corresponding to the lower surface of the actuator 12, which has been moved (turned) to the "working position (closed position)", and the medium pressing portions 12*c* are formed by projecting linear portions disposed at predetermined pitch intervals therebetween in the connector longitudinal direction, which is the multipolar arrangement direction of the electrically-conductive contacts (contact members) 13. The projecting linear portion, which forms each of the medium pressing portions 12*c*, is extending in a long and thin shape along the turning radial direction of the actuator 12, and the transverse cross-sectional shape thereof along the multipolar arrangement direction (connector longitudinal direction) is formed so as to form an approximately rectangular shape.

On the other hand, in the intermediate part between the pair of medium pressing portions 12*c* and 12*c*, which are provided so as to be adjacent to each other in the multipolar arrangement direction (connector longitudinal direction) as described above, as shown in FIG. 7, a groove portion 12*e* also extending in a long and thin shape along the turning radial direction of the actuator (connection operating means) 12 is provided to be recessed. Each of the groove portions 12*e* is formed so that the transverse cross-sectional shape thereof along the multipolar arrangement direction (connector longitudinal direction) forms an approximately rectangular shape; and, even in a state in which the actuator 12 is moved (turned) to the "working position (closed position)", the groove portions 12*e* become a state in which they are not in contact with the upper surface (first-side surface) of the signal transmission medium (FPC, FFC, or the like) F and are configured not to carry out a pressing action with respect to the signal transmission medium F.

The medium pressing portions 12*c* provided on the actuator (connection operating means) 12 in this manner are disposed at the same positions as the electrically-conductive contacts 13 in the multipolar arrangement direction (connector longitudinal direction) of the electrically-conductive contacts (contact members) 13. Therefore, the medium pressing portions 12*c* of the actuator 12 are in a disposition relation in which the medium pressing portions 12*c* face the electrically-conductive contacts 13 from directly above when the actuator 12 disposed at the "standby position (opened position)" in a manner that it is flipped up to the upper side is subjected to the turning operation so as to be pushed down approximately horizontally toward the connector front side and is moved (turned) to the "working position (closed position)".

Figure 15:
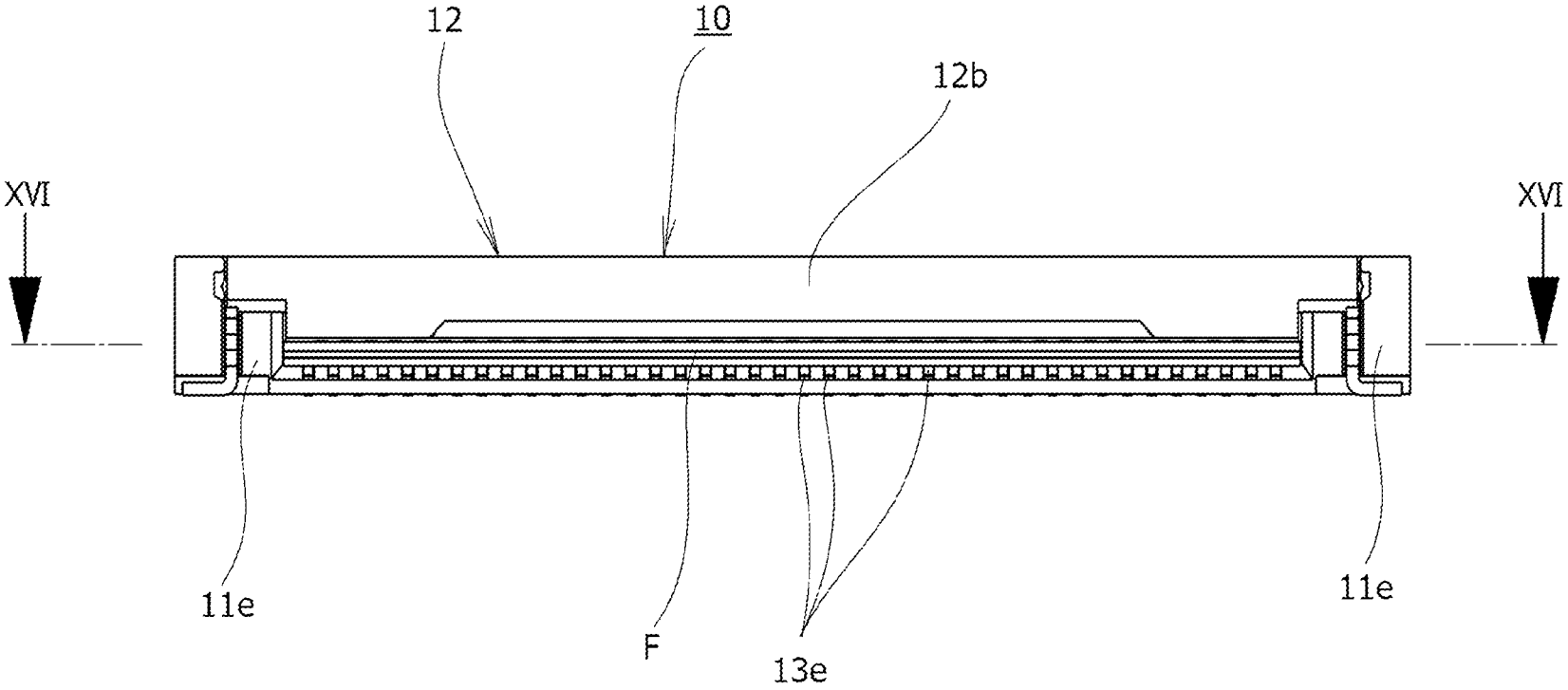
FIG. 15 is an explanatory front view showing the electric connector and the signal transmission medium in the positional relation shown in FIG. 13 and FIG. 14.

More specifically, when the actuator (connection operating means) 12 is turned to the "working position (closed position)" (see FIG. 13 to FIG. 15) in the state in which the terminal part of the signal transmission medium (FPC, FFC, or the like) F is inserted in the insulating housing 11 (see FIG. 11 and FIG. 12), the medium pressing portions 12*c* of the actuator 12 formed by the long-and-thin-shaped projecting linear portions as described above press the upper-side surface (first-side surface) of the signal transmission medium F toward the lower side. As a result, the wiring patterns provided in the side of the lower surface (second-side surface) of the signal transmission medium F are pressed against the contact portions 13*f* of the electrically-conductive contacts (contact members) 13.

On the other hand, the groove portions 12*e*, each of which is provided in the intermediate part between the pair of medium pressing portions 12*c* and 12*c* adjacent to each other in the multipolar arrangement direction (connector longitudinal direction) as described above are maintained in the state in which they are not in contact with the surface of the signal transmission medium (FPC, FFC, or the like) F even when the actuator (connection operating means) 12 has been turned to the "working position (closed position)". Since the groove portions 12*e* like this are provided, elastically deformed parts of the signal transmission medium F are housed in the spaces of the groove portions 12*e*, and the retaining force in the multipolar arrangement direction with respect to the signal transmission medium F is improved.

Furthermore, as shown in FIG. 6 and FIG. 14, in part of the medium pressing portion 12*c*, which is provided in the actuator (connection operating means) 12, a deformation allowing portion 12*f* is provided so as to be communicated from the outer surface of the medium pressing portion 12*c* to the above described bearing housing portion 12*d*. The deformation allowing portion 12*f* consists of a through hole which is formed at a somewhat rear-side position of the position directly above the contact portion 13*f* of the electrically-conductive contact (contact member) 13 in the state in which the actuator (connection operating means) 12 is turned to the "working position (closed position)", and the elastically deformed part of the signal transmission medium F is configured so as to be housed in the space in the inner side of the above described deformation allowing portion 12*f* when the medium pressing portion 12*c* of the actuator 12 presses the signal transmission medium (FPC, FFC, or the like) F in the above described manner.

As described above, according to the electric connector 10 according to the present embodiment, when the actuator (connection operating means) 12 is moved (turned) to the "working position (closed position)", the medium pressing portions 12*c* of the actuator 12 at the positions directly opposed to the contact portions 13*f* of the electrically-conductive contacts (contact members) 13 press the signal transmission medium (FPC, FFC, or the like) F, and the contact pressures applied from the medium pressing portions 12*c* of the actuator 12 to the signal transmission medium F are reliably applied to the contact portions 13*f* of the electrically-conductive contacts 13 without being dispersed.

Moreover, in the present embodiment, since the groove portions 12*e* are formed in the intermediate parts between the medium pressing portions 12*c* of the actuator (connection operating means) 12, only the medium pressing portions 12*c* of the actuator 12 are brought into pressure-contact with the upper surface (first-side surface) of the signal transmission medium (FPC, FFC, or the like) F, and the contact pressures of the contact portions 13*f* of the electrically-conductive contacts (contact members) 13 opposed to the medium pressing portions 12*c* of the actuator 12 are more reliably applied to the signal transmission medium F.

Furthermore, in the present embodiment, the elastically deformed parts of the signal transmission medium (FPC, FFC, or the like) F generated by pressing by the medium pressing portions 12*c* of the actuator (connection operating means) 12 are housed in the deformation allowing portions 12*f*, which are provided in the actuator 12. As a result, the signal transmission medium F is caused to be in a latched state, and the retaining characteristic of the signal transmission medium F is therefore improved.

Furthermore, in the present embodiment, since part of the electrically-conductive contact (contact member) 13 including the bearing portion 13*d* is structured to be housed in the bearing housing portion 12*d*, which is provided in the actuator (connection operating means) 12. Therefore, the entire electric connector is downsized.

In addition, the bearing housing portion 12*d* provided in the actuator (connection operating means) 12 in the present embodiment is communicated with the deformation allowing portion 12*f*. Therefore, when the actuator 12 is to be formed by molding, the structure of a mold(s) for molding the bearing housing portions 12*d* and the turning shaft 12*a* is easily mold-released through the part corresponding to the deformation allowing portions 12*f*, and productivity is improved.

Hereinabove, the invention accomplished by the present inventors have been explained in detail based on the embodiment. However, the present invention is not limited to the above described embodiment, and it goes without saying that various modifications can be made within the range not departing from the gist thereof.

For example, in the above described embodiment, the flexible printed circuit (FPC) and the flexible flat cable (FFC) are employed as the signal transmission media to be fixed to the electric connector. However, the present invention can be similarly applied also to the cases in which other signal transmission media, etc. are used.

The actuator according to the above described embodiment is configured to be turned toward the connector front side. However, the present invention can be similarly applied also to an electric connector in which it is configured to be turned toward the connector rear side.

The electric connector according to the above described embodiment employs the configuration in which the electrically-conductive contacts having the same shape are arranged in multipolar shapes. However, the present invention can be similarly applied also to the cases in which electrically-conducive contacts having mutually different shapes are used.

The present invention can be widely applied to various electric connectors which are used in various electric devices.

What is claimed is:

1. An electric connector, comprising:

a plurality of contact members arranged to form a multipolar shape, each of the contact members including a contact portion; and an actuator including a plurality of medium pressing portions, the actuator configured to move to a working position in a state in which a first-side surface of a signal transmission medium is disposed to face the contact portions of the plurality of contact members, thereby bringing the plurality of medium pressing portions into pressure-contact with a second-side surface of the signal transmission medium and electrically connecting the contact portions of the plurality of contact members with the signal transmission medium, wherein the plurality of medium pressing portions are provided at a predetermined interval therebetween in a direction of the multipolar shape, each medium pressing portion of the plurality of medium pressing portions is disposed at a position corresponding to a contact portion of a respective contact member, and when the actuator is moved to the working position, the plurality of medium pressing portions and the contact portions of the plurality of contact members are disposed so as to be directly opposed to each other.

2. The electric connector according to claim 1, wherein a groove portion is provided at a recessed position on an intermediate part between the plurality of medium pressing portions mutually adjacent in the direction of the multipolar arrangement, and when the actuator is moved to the working position, the groove portion is configured to be in a state in which the groove portion is not in contact with the surface of the signal transmission medium.

3. The electric connector according to claim 1, wherein at least one of the medium pressing portions includes a deformation allowing portion that houses an elastically deformed part of the signal transmission medium when the contact portion of the corresponding contact member is brought into pressure-contact with the signal transmission medium.

4. The electric connector according to claim 1, wherein the actuator further includes a shaft portion extending along the direction of the multipolar shape, and at least one contact member of the contact members includes a bearing portion that turnably supports the shaft portion of the actuator.

5. The electric connector according to claim 4, wherein the actuator further includes a bearing housing portion with a space that houses the bearing portion of the at least one contact member, and the medium pressing portion corresponding to the at least one contact member is disposed at a same position as the bearing housing portion in the direction of the multipolar shape.

6. The electric connector according to claim 5, wherein the medium pressing portion, corresponding to the at least one contact member, further includes a deformation allowing portion that houses an elastically deformed part of the signal transmission medium when the at least one contact portion of the contact member is brought into pressure-contact with the signal transmission medium, and the bearing housing portion is communicated with a deformation allowing portion.

* * * * *